US005682860A

United States Patent [19]

Kollmann et al.

[11] Patent Number: 5,682,860

[45] Date of Patent: Nov. 4, 1997

[54] DEVICE AND METHOD FOR IGNITION DETECTION

[75] Inventors: Ekkehard Kollmann, Passau; Udo Mai, Untergriesbach; Roman Schichl, Passau, all of Germany

[73] Assignee: Vogt Electronic AG, Obernzell, Germany

[21] Appl. No.: 658,177

[22] Filed: Jun. 4, 1996

[30] Foreign Application Priority Data

Jun. 8, 1995 [DE] Germany ..... 195 20 852.8

[51] Int. Cl.[6] ..... F02B 77/08; F02P 17/00

[52] U.S. Cl. ..... 123/481; 73/35.06; 73/35.08; 73/116; 123/630; 324/380

[58] Field of Search ..... 123/479, 481, 123/630; 73/35.06, 35.08, 116, 118.1; 324/382, 388, 399

[56] References Cited

U.S. PATENT DOCUMENTS

| | | | |
|---|---|---|---|
| 5,388,560 | 2/1995 | Hisaki et al. | 123/630 |
| 5,503,132 | 4/1996 | Miyata et al. | 123/630 |
| 5,592,926 | 1/1997 | Miyata et al. | 123/630 |

FOREIGN PATENT DOCUMENTS

| | | |
|---|---|---|
| 0546827 | 6/1993 | European Pat. Off. . |
| 4218803 | 12/1993 | Germany . |
| 9220912 | 11/1992 | WIPO . |

*Primary Examiner*—Tony M. Argenbright
*Attorney, Agent, or Firm*—Cowan, Liebowitz & Latman, P.C.; R. Lewis Gable

[57] ABSTRACT

The process for ignition detection for an ignition system in a combustion engine wherein a first ignition pulse is generated in a cycle for generating a first ignition spark and at least a second ignition pulse for generating a second ignition spark provides that the alternating voltage for generating at least the second ignition pulse has one or more periods with half-waves having different amplitudes. The first half-wave has an amplitude between the maximum voltage required in the presence of ionization between the electrodes of a spark plug in the ignition system, and between the minimum voltage required in the absence of ionization. The second half-wave has an amplitude exceeding the maximum voltage required. The criterion measured for an ignition of the fuel-air mixture having taken place is whether or not the second ignition spark was generated with the first half-wave of the alternating voltage.

16 Claims, 4 Drawing Sheets

U
I1
I1A
I1B
I2
I2A
I2B
AT
t1
t2
t

U1A
U2A

U1A
U2A

U1A
U1B
U2A
U2B

U1A
U1B
U2A
U2B

U1A
U1B
U2A
U2B

DEVICE AND METHOD FOR IGNITION DETECTION

FIELD OF THE INVENTION

The invention relates to a process for ignition detection.

BACKGROUND OF THE INVENTION

In modern motor vehicles, environmental protection considerations make it necessary to detect the ignition of the fuel-air mixture in a combustion engine and to immediately initiate countermeasures if no ignition takes place. The reason for this is that if no countermeasures are implemented, the unburned fuel-air mixture is able to pass into the catalyzer and destroy it. It is therefore necessary that each ignition failure be detected.

Various devices and methods for detecting the ignition or ignition failure are already known. It is, for example, possible to measure the increase in pressure in the combustion chamber that is caused by the combustion of the fuel mixture. For this, a pressure sensor can be disposed inside the engine block. This is very complex and expensive. Another disadvantage is that this pressure sensor is also exposed to enormous thermal stresses.

Processes for generating two ignition pulses within one operating cycle for ignition or ignition failure detection are described, for example, in DE 42 18 803 A1, EP 0 546 827 A2, and U.S. Pat. No. 5,388,560. While DE 42 18 803 A1 evaluates the amplitude of the sparking voltage spike pulse generated during the second ignition, U.S. Pat. No. 5,388,560 implements a time analysis of the drop in the measured sparking voltage following the second ignition. In EP 0 546 827 A2, a corresponding analysis of the drop in the generated ion stream is performed.

In another known device, the angular velocity of the crankshaft, which is higher after a combustion has taken place than when it has not taken place, is measured. But this requires additional, mechanical sensors which must be extremely sensitive so that they can detect relatively small differences in speed. Such sensors are also complex and expensive.

Another way of detecting the ignition is by measuring the ion stream. This consists of measuring the ion stream caused by the thermal ionization of the fuel mixture during ignition. This solution requires diodes which are subject to an enormous voltage during the ignition pulse. Such diodes are very expensive and sensitive.

WO 92/20912 describes an ignition detection in which two ignition sparks are generated within one cycle of the combustion engine, and the ignition voltage of the second ignition spark is compared to a predefined threshold value, An ignition of the fuel mixture is recognized by the fact that the ignition voltage of the second spark falls below this threshold value. However, if the ignition voltage exceeds this threshold value, this is a criterion indicating an ignition failure of the fuel mixture.

The problem with this process is that only the ignition voltage of the second ignition spark is measured. It is not possible to use this process to determine whether the ignition voltage was reduced solely by the ionization of the first spark or, in fact, by an ignition that occurred inside the combustion chamber. In addition, it is not possible with this process to determine whether an ignition took place because no suitable ignition spark was generated, or because no fuel mixture was available for the ignition in the combustion chamber.

Additionally, the measured ignition voltage also depends on external factors, such as, for example, on the voltage drop at the distributor and on the electrode consumption. Such factors can change slowly over the course of time, or rapidly, for example, when spark plugs are replaced. These factors cannot be taken into account if only a single threshold value is given as a definitive criterion for deciding whether an ignition of the fuel mixture has taken place. To vary the threshold voltage dependent on these factors would only be possible with great expenditure, even if a commensurate processor control were used.

SUMMARY OF THE INVENTION

The present invention is based on the objective of providing a process for ignition detection which does not have the above mentioned disadvantages and, in particular, does not contain any mechanical components and which is easily integrated into existing systems and operates reliably.

In accordance with this and other objects of the invention, the invention is based on igniting the fuel mixture in the combustion chamber of a motor vehicle combustion engine by way of a first ignition spark, and on detecting the ignition of the fuel mixture with at least one Second ignition spark ignited in the same cycle. According to the invention, the alternating voltage for generating at least the second ignition spark, preferably, however, also for generating the first ignition spark, has one or more cycles of two half-waves with different amplitudes, the first half-wave having an amplitude between the maximum voltage required in the presence of ionization between the electrodes of a spark plug in the ignition system, and between the minimum voltage required in the absence of ionization, and the second half-wave having an amplitude exceeding the maximum voltage required. The criterion measured for determining whether an ignition of the fuel-air mixture has taken place is whether or not the second ignition spark was generated with the first half-wave of the alternating voltage.

It is preferred that the voltage of the first half-wave of the alternating voltage for generating the ignition spark or ignition sparks be between 2 kV and 6 kV. According to the invention, the voltage of the second half-wave is greater than 30 kV, and is preferably approximately 32 kV.

If the duration of the alternating voltage cycle is distinctly smaller than the duration of the combustion engine cycle, the following function sequence can be generated. The first ignition pulse is generated so as to include one or more cycles (partial ignition pulses) of the alternating voltage, whereby the ignition spark is formed during the second half-wave. This first ignition pulse normally ignites the fuel-air mixture. As already mentioned, after a certain time within the same cycle, a second ignition pulse which can also include several partial ignition pulses is generated. Ions which were generated by the flame are now present between the electrodes of the spark plug, thus enabling the lower voltage of the first half-wave of the second ignition pulse to generate the ignition spark. The time passing from the switching on of the alternating voltage until the formation of the spark can be used, for example, to provide information about the ignition of the fuel-air mixture by measuring the current through the spark plugs. If ignition has taken place via the ignition spark generated by the first ignition pulse, the ignition spark of the second ignition pulse occurs during the first half-wave. If no ignition was caused by the first ignition pulse, the ignition spark only ignites during the second ignition pulse with the second half-wave, i.e. later than normal. This is what is detected according to the invention.

Especially in the case of high speeds, the ionization generated by the first spark itself may not yet have been fully eliminated. This means that the voltage necessary for generating the second spark is reduced, i.e. becomes smaller than, for example, 6 kV. In order to return the amplitude of the first half-wave of the alternating ignition voltage to the optimum range, i.e. to the middle between the maximum voltage required with full thermal ionization and minimum voltage required with residual ionization caused by the first spark, the duration of the two half-waves in relation to each other, for example, can be modified—something which can be utilized to change the amplitude of the first half-wave. An appropriate field of characteristics stored in the control processor of the motor vehicle can be used, for example, to control the amplitude of the first half-wave.

Although in principle it is sufficient that the ignition voltage of the two ignition pulses is measured, in is also possible to evaluate not the high voltage itself but rather a value proportional to it. Such a value can be the primary voltage on an ignition coil of the ignition system, for example. But it is also possible that the primary charging current of an ignition coil of the ignition system is evaluated as a proportional value for the ignition voltage.

It is also possible that another parameter containing information about the ionization of the gas discharge distance is evaluated. If the primary charging current of the ignition coil is used, it is indeed found that the charging current depends on the primary inductance of the ignition coil as long as the discharge distance is not ionized. If an ionization is present, however, the effective primary inductance is reduced by switching the leakage inductance parallel. The current in the ignition coil increases more rapidly. This difference in the current increases, which can be determined for example by measuring the time from the beginning of the current flow until a certain current amplitude is reached, is also a measure for the ionization present between the electrodes which can be evaluated.

Another further development of the invention provides that not only two ignition pulses are generated within a cycle, but that each of these ignition pulses is divided into at least two partial ignition pulses. Suitable ignition systems for this are, for example, high frequency alternating current ignition systems which are able to rapidly generate several sparks consecutively within a single cycle. The partial ignition cycles of an ignition pulse are triggered so rapidly one after the other that the ionization caused by the respective, immediately preceding partial ignition pulse and the partial spark thereby forming has been only insignificantly reduced. If during this process a spark is triggered as a result of the first partial ignition pulse, and if the gas discharge was produced, then a substantial difference can be detected between the ignition voltages of these two partial ignition sparks. Such a difference does not exist if the first partial spark did not form.

A third case may also occur. This third case occurs if a fuel-air mixture inside the combustion chamber was ignited by the partial sparks of the first pulse. The ignition inside the combustion chamber now ensures an ionization of the discharge distance, resulting in the first partial spark of the second spark occurring at a much lower ignition voltage than was the case for the first partial spark of the first spark. By evaluating the ignition voltages or charging currents of the partial sparks of the first and second spark it can therefore be determined whether an ignition failure can be attributed to the absence of fuel-air mixture or to the spark not being produced.

In a further development of the invention, a corresponding signal is sent to a control unit as soon as an ignition failure of the fuel-gas mixture has occurred. The supply of the fuel-air mixture to the combustion chamber is also interrupted in order to avoid a destruction of the catalyst. Finally, an acoustic or optical signal indicating the malfunction is transmitted to the driver of the combustion engine.

BRIEF DESCRIPTION OF THE DRAWINGS

The invention is explained in more detail below in reference to an exemplary embodiment and drawings, in which.

DESCRIPTION OF PREFERRED EMBODIMENT OF THE INVENTION

Figure 1:
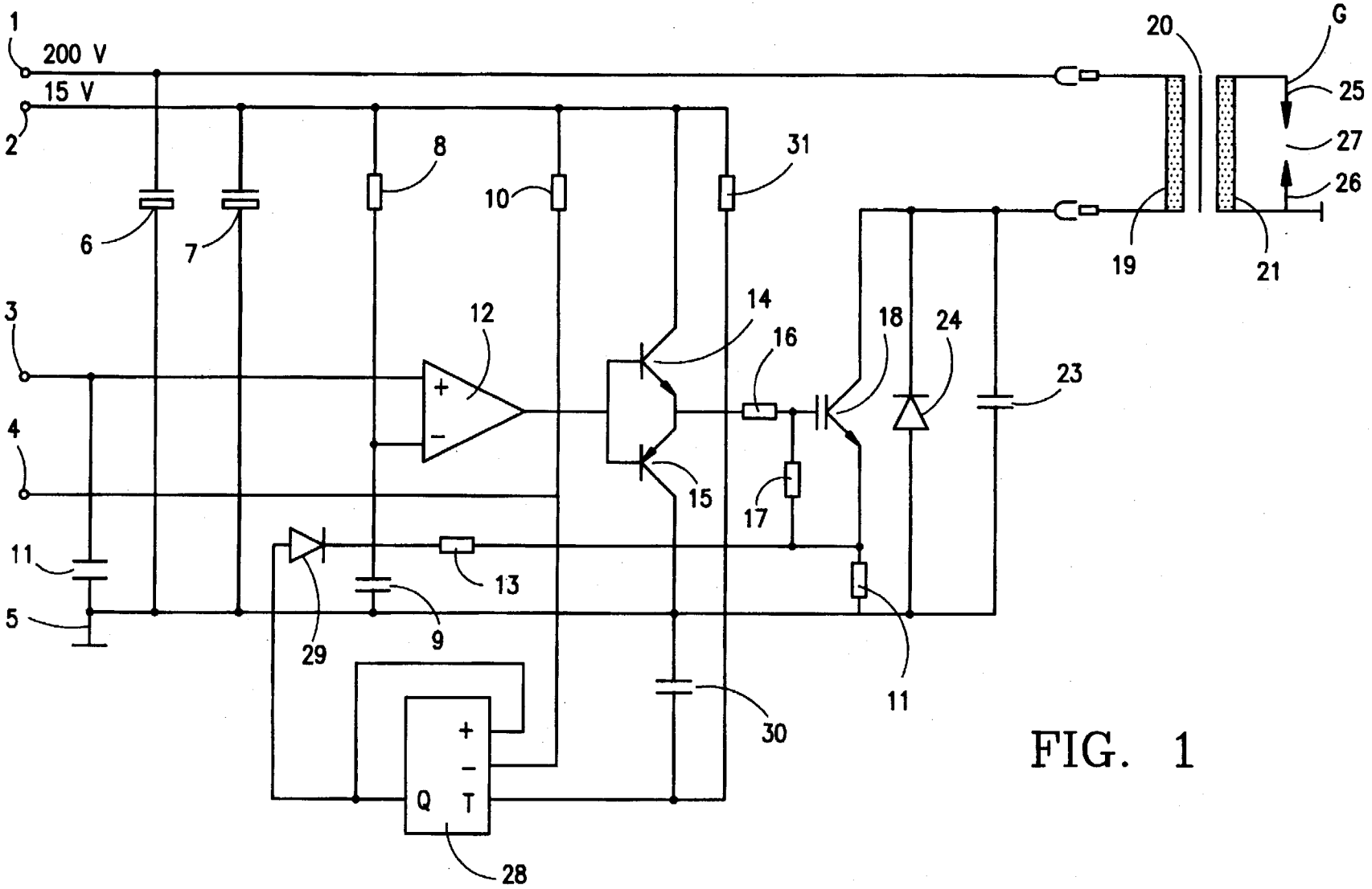
FIG. 1 shows a block switching diagram of an exemplary ignition terminal stage for ignition detection.

FIG. 1 shows an exemplary embodiment of a circuit arrangement for an ignition terminal stage according to the present invention. The circuit arrangement has five terminals 1, 2, 3, 4, and 5. For example, terminal 1 is connected to 200 V, terminal 2 to 15 V, terminal 3 to a current control signal, and terminal 4 to a starting signal. Terminal 5 is connected to a reference potential. A capacitor 6 is connected between terminal 1 and terminal 5, and a capacitor 7 is also connected between terminal 2 and terminal 5. A resistor 8 connected in series with a capacitor 9 is also connected between terminals 2 and 5, whereby the resistor 8 is in connection with terminal 2. Terminal 2 is connected via another resistor 10 to terminal 4. Another capacitor 11 is connected between terminal 3 and terminal 5 for reference potential. Terminal 3 is connected to the non-inverting input of a comparator 12 whose inverting input is connected to the connection point of the resistor 8 and capacitor 9. The output of the comparator 12 is on the one side in connection with terminal 4, and on the other side with two base connections of two complementary transistors 14, 15 which are connected with each other via their emitter connections. The collector of the npn transistor 14 is connected to terminal 2, the collector of the pnp transistor 1B to terminal 5. The connection point of the two emitter connections of these transistors 14, 15 is connected via a resistor 16 to the base connection of a power transistor 18. The collector connection of this power transistor 18 is connected via the primary winding 19 of an ignition coil 20 to terminal 1. The emitter connection of the power transistor 18 is connected via a resistor 11 to terminal 5 for reference potential. Parallel to the serially connected power transistor 18 and resistor 11, a capacitor 23 is connected, as well as a recovery diode 24 which is placed with its cathode connection on the primary winding 19 of the ignition coil 20.

The connection point of resistor 8 and capacitor 9 is connected via another resistor 13 to the connection point of power transistor 18 and resistor 11. The connection point mentioned last is connected simultaneously via a resistor 17 to the base or gate of the power transistor 18.

In addition, the ignition coil has a secondary winding 21, with the two connections of the latter being connected to electrodes 25, 26.

The circuit arrangement shown in FIG. 1 also has a clock generator. This clock generator consists essentially of a clock generator component 28 whose plus input is connected to the Q output. The Q output is also in contact via a diode 29 with the connection point of resistor 8 and capacitor 9. The cathode of diode 29 has been connected to this connection point. The minus input of the clock generator component 28 is connected to terminal 4, while the clock input is connected via a capacitor 30 to terminal 5 for reference potential. Another resistor 31 is connected between the clock input of the clock generator component 28 and terminal 2.

Figure 3:
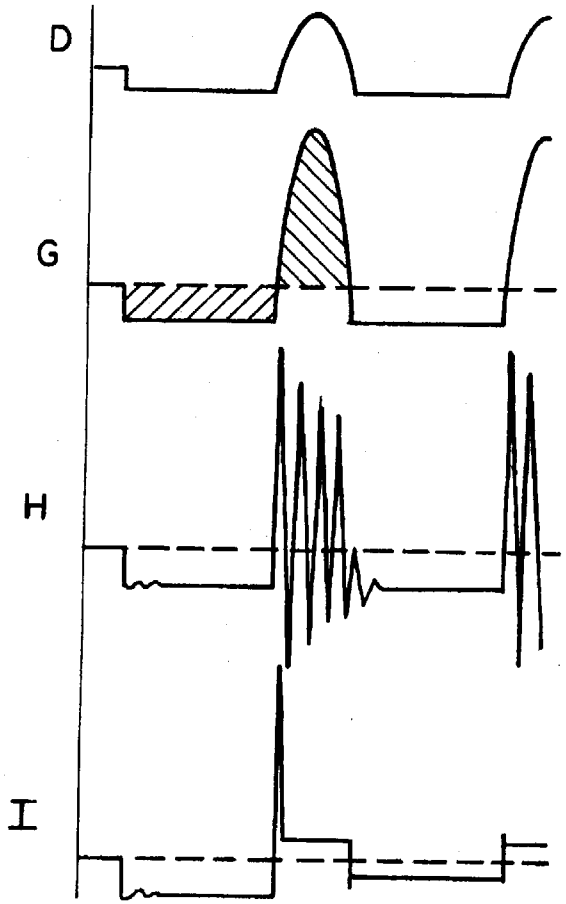
FIG. 3 shows typical signal curves on the secondary side of the ignition terminal stage shown in FIG. 1.
Figure 2:
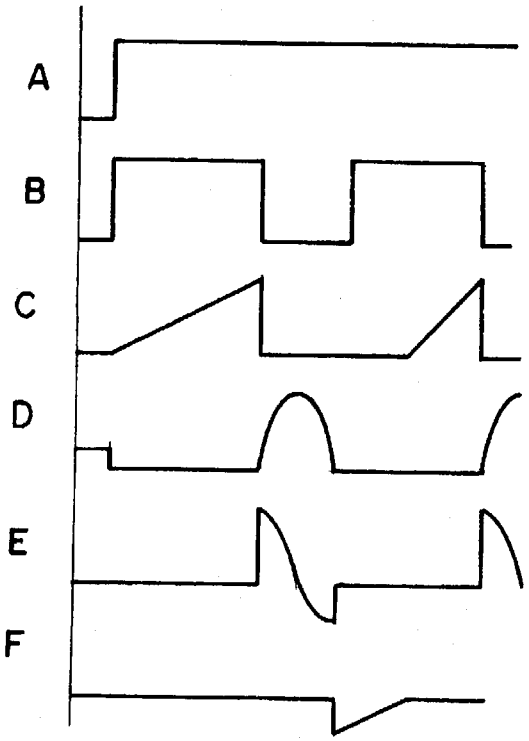
FIG. 2 shows typical signal curves on the primary side of the ignition terminal stage shown in FIG. 1.

The circuit arrangement of an ignition stage shown in FIG. 1 can be used to essentially generate the signals described in FIGS. 2 and 3.

In FIG. 2, the starting signal for turning the ignition terminal stage on is designated with A. This starting signal is connected to terminal 4 of the ignition terminal stage and is a rectangular signal with a predetermined duration. B designates the gate or base voltage of the power transistor 18. This signal is a rectangular voltage whose durations depend on the current through the ignition coil. C designates the collector current which is a triangular ramp signal. The rate-of-rise of the ramp again depends on the ignition coil inductance. D designates the collector voltage on the capacitor 23 of the ignition terminal stage of FIG. 1. The collector voltage D has a sinus half-wave shape. Signal curve E designates the current flowing through this capacitor 23. F designates the current through recovery diode 24.

FIG. 3 shows the typical signal curves on the secondary side of the ignition terminal stage of FIG. 1. For the purpose of better clarity, the sinus half-wave-shaped curve of the collector voltage is shown again with the help of curve D. G designates the ideally transformed secondary voltage on the secondary side of the ignition terminal stage. The reference line representing 0 Volt and drawn as a broken line shows that this signal curve G is characterized by an area (shown in cross-hatch) below 0 Volt and a voltage area (shown in cross-hatch) above 0 Volt. The areas which have been marked with different cross-hatchings are of equal size.

H designates the secondary voltage with capacitance. In contrast to signal curve G, this signal oscillates at the point where the collector voltage exhibits a half-wave.

Signal curve I shows the typical secondary voltage for a spark plug connected to the secondary winding of the ignition coil.

Figure 4:
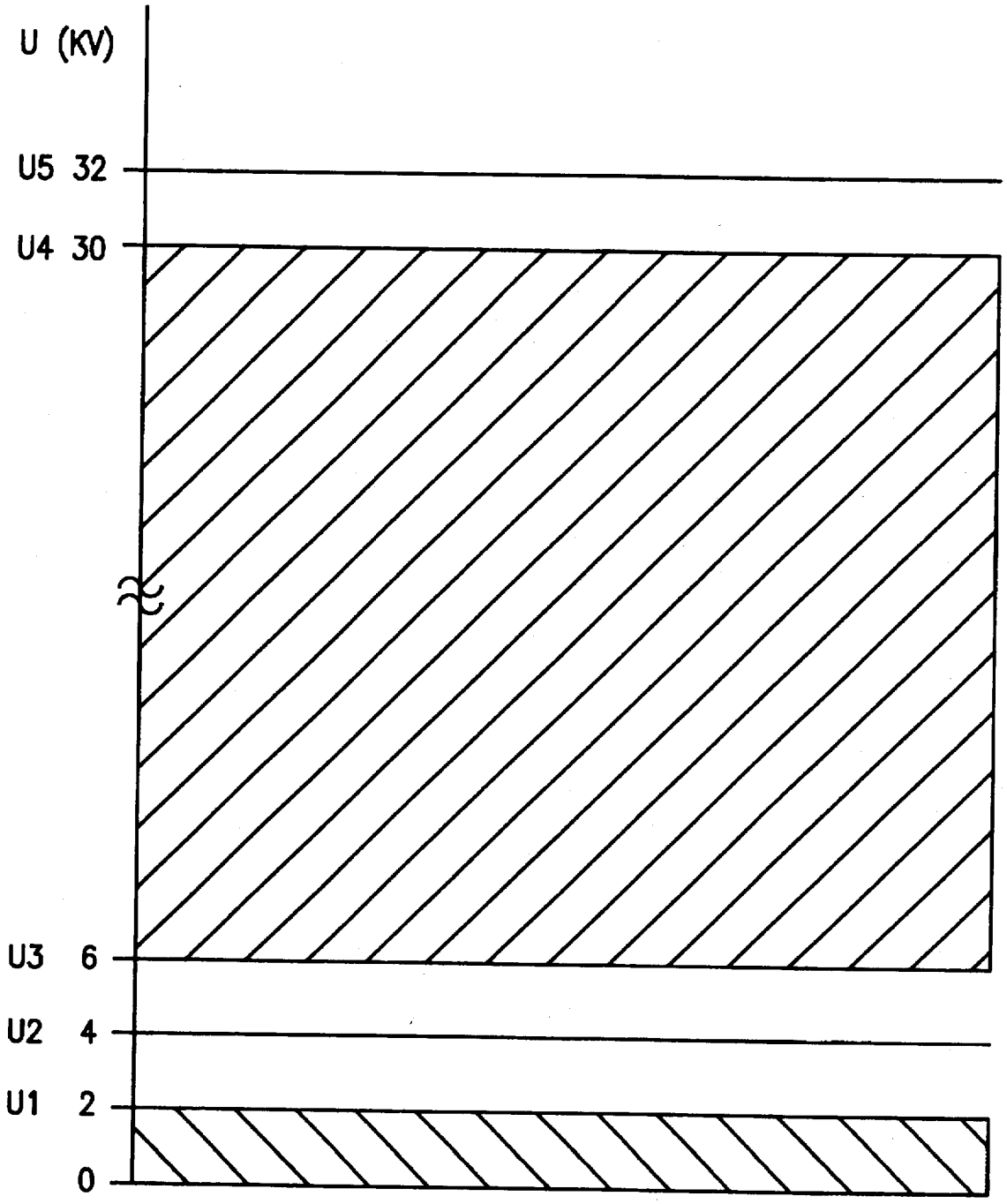
FIG. 4 shows a voltage diagram.

FIG. 4 shows in an exemplary manner how the alternating voltage for generating the ignition sparks should be selected in the present invention. Starting with a voltage 0, other voltages are drawn in the diagram shown in FIG. 4, i.e. U1=2 kV, U2=4 kV, U3=6 kV, U4=30 kV, and U5=32 kV. At 2 kV, the sparks form when the space between the electrodes is ionized. Between 6 kV and 30 kV, ignition can be achieved in the absence of ionization, but ignition is only achieved for certain with a voltage greater than 30 kV. According to the present invention, the alternating voltage for generating at least the second ignition spark, preferably, also for generating the first ignition spark, however, has one or more cycles of two half-waves with different amplitudes, the first half-wave having an amplitude between the maximum voltage required in the presence of ionization between the electrodes of a spark plug in the ignition system, and between the minimum voltage required in the absence of ionization, and the second half-wave having an amplitude exceeding the maximum voltage required. In the present case, this means that the first half-wave must be between U1 and U3, and thus must not be in the cross-hatched area. It is preferred that the first half-wave be selected at U2=4 kV. The second half-wave in contrast is selected so that it definitely exceeds the maximum required voltage occurring in the presence of ionization between the electrodes of a spark plug of the ignition system. In the present case, the second half-wave must consequently be greater than U4. It is preferred that the second half-wave be selected equal in size to U5.

If the first and second ignition pulses are generated in the same manner and thus with the same alternating voltage, the second ignition voltage can be used to determine whether or not the first ignition pulse has brought about ignition. The reason for this is that if ignition has taken place, the first half-wave of the second ignition pulse is already able to generate an ignition spark. If the first ignition spark has not caused an ignition, only the second half-wave of the second ignition pulse will initiate ignition. Naturally, this is only the case if a fuel-air mixture is present in the combustion chamber.

The process according to the invention thus utilizes the following effect. The critical field intensity necessary for the production of a gas discharge depends on the presence of ions present in the combustion chamber and on the presence of external ionization. In the case of constant geometric dimensions and constant external influences, the voltage necessary for producing a gas discharge or spark between two electrodes, e.g., the electrodes of a spark plug, is also constant. If ions are now brought into the electrode area by external ionization, for example by thermal ionization as it occurs during an ignition of the fuel mixture in the combustion chamber, the ignition voltage required for generating a spark is reduced.

Two ignition pulses are generated within a cycle of a combustion engine. The first ignition pulse which ideally creates a spark is used to ignite the fuel-air mixture. The second ignition pulse also generates a spark. But in the case of the Second ignition pulse the exact time of the spark formation is detected, i.e. whether at the time of the first half-wave or second half-wave.

It cannot be easily decided whether this ionization was a result of the first spark triggered by the .first ignition pulse or by the ignition of the fuel-air mixture. One possibility of deciding this for certain is to select the time between the two ignition pulses so that the ionization produced by the first spark has been definitely eliminated. If the second voltage value is distinctly lower than the first one, this certainly indicates an ignition of the fuel mixture. The duration of this ionization depends on the connected high voltage itself and the swirling conditions in the combustion chamber, so that a relatively long time frame may be necessary until the ionization has been eliminated. In particular in the case of high speeds this may lead to time problems if this time duration becomes longer than the cycle duration, since the second pulse then no longer can be ignited during this one cycle.

In the process according to the invention, the duration of the two pulses is so short that they definitely occur within one cycle. The duration hereby can be selected either as constant or variable, i.e. dependent on speed.

The process according to the invention can also be used advantageously in ignition systems, for example high frequency alternating current ignition systems, in which several ignition pulses can be generated rapidly and consecutively within a single cycle. As is shown below, these systems enable an additional determination of whether an ignition of the fuel mixture is failing because no ignition spark was produced, or because no fuel mixture is present in the combustion chamber.

According to one aspect of the invention, the two ignition pulses mentioned above are generated in the form of at least two ignition pulses each.

For simplicity, the following assumes that one ignition spark consists of only two partial sparks. According to another aspect of the invention, the time interval between these two partial sparks may be so small that the ionization in the combustion chamber produced by the partial spark has only insignificantly decreased, and at least two partial sparks appear like a single spark.

If for example, the first partial spark is triggered in this example, and if, due to the first partial spark, a gas discharge was produced inside the combustion chamber, a substantial difference is determined between the ignition voltages of this first partial spark and the immediately following, second partial spark. Furthermore, the collector current flowing on the primary side of the ignition system reaches the amplitude necessary for ignition faster. This substantial difference between the two ignition voltages of the two partial sparks and between the rates-of-rise of the flanks of the collector current does not occur, however, if the first partial spark was not produced as a result of the first partial pulse. The conditions just described may also occur for the following two partial sparks of the second spark, whereby the first partial spark of the second ignition pulse occurs at the second half-wave, i.e. earlier than in the case of the first ignition pulse not having resulted in any ignition. But in addition, a third case may occur here. This third example occurs if a fuel-air mixture in the combustion chamber was ignited by the first partial spark of a pulse. In this example the flame in the combustion chamber produces an ionization of the discharge distance, resulting in the first partial spark of the second spark occurring at a much lower ignition voltage than in the case of the first partial spark of the first spark. By evaluating the current increase of the partial sparks of the first and second spark or the corresponding currents through the primary winding, it is therefore possible to decide whether an ignition failure can be attributed to an absence of a fuel-air mixture or to a failure of a spark forming inside the combustion chamber.

This principle is described in more detail below using FIG. 5 in reference to various voltage/time diagrams. In order to be able to emphasize the essential facts, the curves have been reduced to symbols for the ignition voltage curve for an ionized (diagram C, curve U2A) or non-ionized (diagram C, curve U1A) electrode interval.

Figures 5A, 5B, 5C, 5D, 5E, 5F:
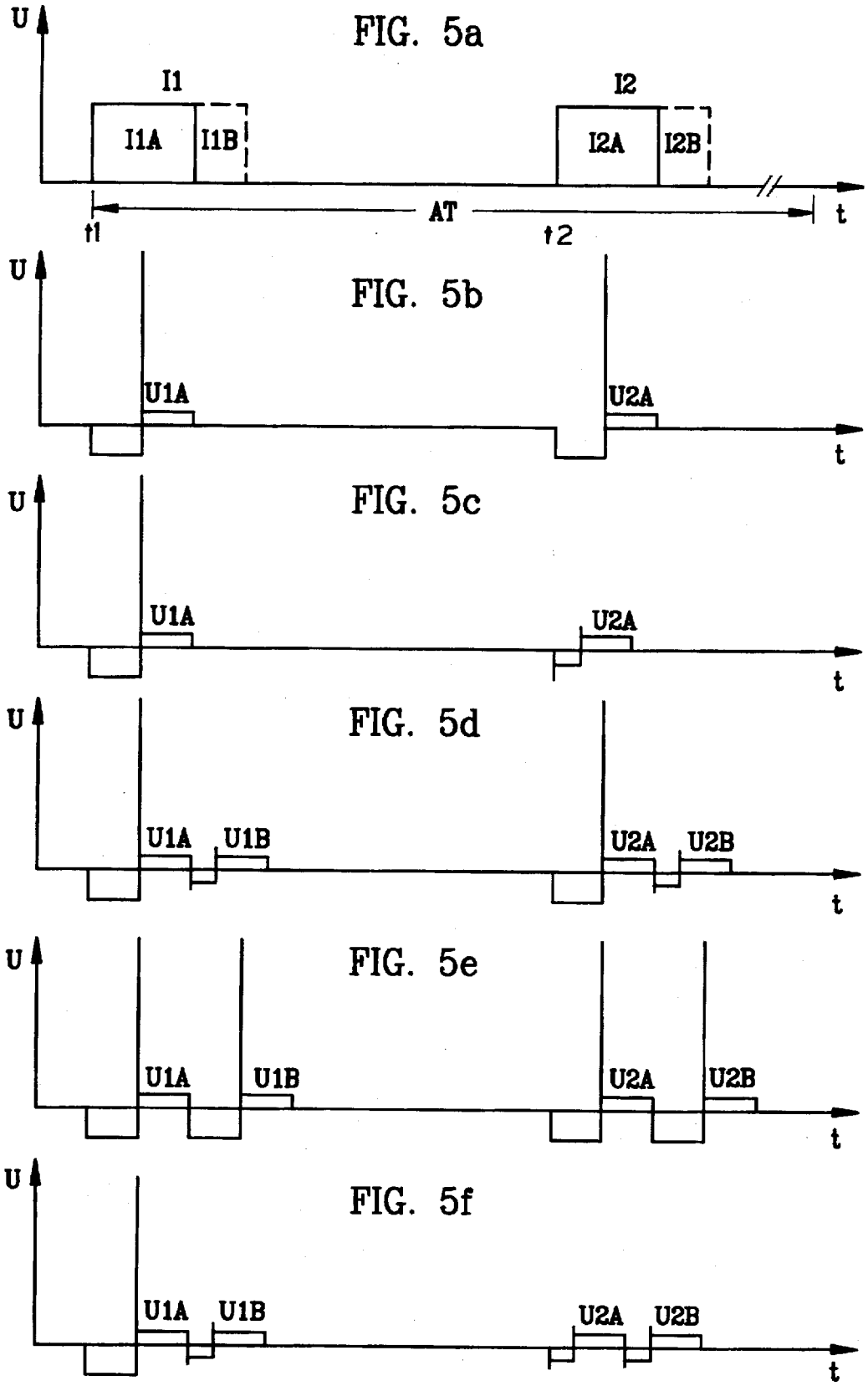
FIG. 5 shows voltage/time diagrams of four ignition sparks following each other within a combustion engine cycle for various operating conditions.

FIG. 5*a* shows pulses I1, I2 which are used for generating ignition pulses in a cycle AT of the combustion engine. It is first assumed that each of these pulses I1, I2 consists of a single pulse I1A, I2A. The ascending flank of the first pulse I1A appears at time t1, and the ascending flank of the second pulse I2A appears at time t2. The two points in time t1, t2 occur within cycle AT. The interval between times t1, t2 has been selected so that an ionization in the combustion chamber created by a spark formation generated by the first pulse I1A has definitely decreased in time t2.

FIG. 5*b* shows the ignition voltages U1A, U2A associated with ignition pulses I1A, I2A for the case in which no ignition has taken place inside the combustion chamber. The amplitudes of the two ignition voltages U1A and U2A are equal or approximately equal, since at the time of the occurrence of the second ignition pulse I2A no ionization is present in the combustion chamber any longer. The ignition failure may be a result of either the absence of a fuel-air mixture inside the combustion chamber, or the first pulse I1A not leading to an ignition spark.

FIG. 5*c* shows the ignition voltage conditions for an ignition occurring inside the combustion chamber. The ignition voltage U2A of the second ignition pulse I2A which is smaller than the ignition voltage U1A of the first pulse I1A is clearly visible.

According to an already mentioned further development of the invention, it is possible that each of the already mentioned pulses I1A, I2A is followed immediately by another pulse I1B or I2B respectively. These additional pulses I1B and I2B are represented by broken lines in FIG. 5*a*. These two pulses follow pulses I1A or I2A so closely in time that they appear like a single ignition pulse. FIGS. 5*d*, 5*e* and 5*f* show the associated ignition voltages for different operating conditions.

FIG. 5*d* shows the ignition voltages occurring after a spark has formed inside the combustion chamber as a result of the first partial ignition pulse I1A and a gas discharge was produced, but no fuel-air mixture is present in the combustion chamber. This prevents an ignition from occurring. This ignition failure is detected, similarly to FIG. 5*b*, in that the ignition voltage U2A is approximately equal to ignition voltage U1A. Ignition voltages U1B and U2B which are distinctly lower than ignition voltages U1A or U2A respectively show that a spark was formed as a result of the first ignition pulse I1A. This lower ignition voltage U1B or U2B is a result of the ionization inside the combustion chamber produced by the sparking of the first partial ignition pulse I1A or I2A. Since the partial ignition pulses I1B and I2B follow immediately after the first partial ignition pulses I1A and I2A, this ionization can be detected using the lower ignition voltage U1B or U2B. The lower ignition voltage can be determined by a steeper curve of the collector current on the primary side of the ignition system.

FIG. 5*e* shows the conditions resulting if the first partial ignition pulse I1A does not produce a spark, and thus no gas discharge and ignition occurs inside the combustion chamber. Ignition voltages U1A, U1B as well as U2A and U2B are approximately of the same size.

FIG. 5*f* shows the conditions after an ignition has taken place. Ignition voltages U1B, U2A, and U2B are clearly lower than ignition voltage U1A.

What is claimed is:

1. A process for reliably detecting the occurrence of an ignition of a fuel-air mixture by sparks generated by an ignition system for a combustion engine, the ignition system including a chamber and a spark plug disposed within the chamber and having a pair of electrodes for generating therebetween sparks, the ignition system characterized that the maximum amplitude of the voltage required to be applied across the electrodes to generate a spark therebetween in the presence of ionization between the electrodes is a first amplitude, the minimum amplitude of the voltage required to be applied across the electrodes to generate a spark therebetween in the absence of ionization between the electrodes is a second amplitude and the maximum amplitude of the voltage required to be applied across the electrode to generate a spark therebetween in the absence of ionization between the electrodes is a third amplitude, said process comprising the steps of:

a) generating and applying an alternating voltage to the ignition system to apply across the electrodes within a single cycle of the combustion engine first and second voltage pulses for generating respectively first and second sparks therebetween, said alternating voltage having one or more alternating voltage cycles, each alternating voltage cycle including first- and secondhalf waves of selected amplitude, said first half-wave having an amplitude selected between the first and second amplitudes, said second half-wave having an amplitude selected between the second and third amplitudes; and b) sensing whether or not the second spark was generated with said first half-wave to in turn reliably determine the occurrence of an ignition of the fuel-air mixture within the chamber.

2. The process as claimed in claim 1, wherein the first spark is generated with the same alternating voltage as the second spark.

3. The process as claimed in claim 1, wherein the first and second amplitudes are respectively 2 kV and 6 kV.

4. The process as claimed in one of claim 1, wherein the third amplitude is greater than 30 kV.

5. The process as claimed in claim 1, wherein said first and second half-waves of one cycle of the alternating voltage are varied in relation to each other.

6. The process as claimed in claim 1, wherein the duration between the application of the alternating voltage for the second voltage pulse until the formation of the spark is measured and is used as a criterion for whether an ignition of the fuel-air mixture has taken place.

7. The process as claimed in claim 6, wherein the ignition system includes an ignition coil with a primary side and a secondary side, upon application of the alternating voltage, the current through the ignition coil is measured, and that the duration until the current has reached an amplitude characteristic for the ignition is determined.

8. The process as claimed in one of claim 7, wherein a parameter containing information about the ionization of the gas discharge distance is measured on the primary side of the ignition system as a criterion for detecting the ignition of the fuel-air mixture.

9. The process as claimed in claim 8, wherein on the primary side of the ignition coil, the charging current of the ignition coil is measured.

10. The process as claimed in claim 9, wherein the current increase through the ignition coil is measured, and that a predefined steep current increase is used as a criterion for a successful ignition of the fuel-air mixture.

11. The process as claimed in claim 10, wherein the current increase through the ignition coil is determined by measuring the time from the beginning of the current flow through the ignition coil until it reaches a predefined current amplitude.

12. The process as claimed in claim 1, wherein the first and second sparks are generated with a high frequency alternating current ignition system, and the first and ignition sparks comprise a plurality of partial sparks, the ignition voltages or a value proportional to the partial sparks respectively occurring first are determined, and that the difference therebetween is formed from these ignition voltages and is used as a criterion for determining whether an ignition has taken place.

13. Process as claimed in claim 12, wherein for every partial pulse associated with an ignition pulse, the corresponding ignition voltage or a value proportional thereto is determined, that in each case their voltage difference is determined, and that it is determined from this difference whether an ignition spark has formed.

14. The process as claimed in claim 12, wherein the values of the voltage difference and voltage ignitions are examined to determine whether an ignition of the fuel-air mixture has not taken place because no ignition spark was formed or because no fuel was present in the chamber.

15. The process as claimed in claim 12, wherein the current flow times through the ignition coil are determined and evaluated as a proportional value for the ignition voltage.

16. The process as claimed in one of claim 1, wherein in the absence of the ignition of the fuel-air mixture, the supply of the fuel-air mixture to the chamber is interrupted, and a corresponding signal is transmitted to the operator of the combustion engine.

* * * * *